US005372700A

United States Patent [19]

Pilorge et al.

[11] Patent Number: 5,372,700

[45] Date of Patent: Dec. 13, 1994

[54] METHOD FOR SELECTIVE ELECTROLYTIC DEPOSITION OF A METAL IN PARTICULAR A NOBLE METAL SUCH AS GOLD, ONTO THE INSIDE SURFACE OF BUSH TYPE HOLLOW BODIES, IN PARTICULAR CONNECTOR CONTACT MEMBERS, MACHINE FOR IMPLEMENTING SAID METHOD AND PRODUCT OF SAID METHOD

[75] Inventors: Yannick Pilorge, Chartres; Renaud Roussel, Sarge les le Mans, both of France

[73] Assignee: Framatome Connectors International, Paris la Defense, France

[21] Appl. No.: 29,244

[22] Filed: Mar. 10, 1993

[30] Foreign Application Priority Data

Mar. 20, 1992 [FR] France ..... 92 03358

[51] Int. Cl.[5] ..... C25B 1/00

[52] U.S. Cl. ..... 205/131; 204/224 R; 205/133

[58] Field of Search ..... 205/131, 133, 151; 204/224 R

[56] References Cited

U.S. PATENT DOCUMENTS 4,287,029 9/1981 Shimamura ..... 205/133
4,427,498 1/1984 Wagner ..... 204/26

FOREIGN PATENT DOCUMENTS 2331629 11/1976 France .
2448585 2/1979 France .
2705158 2/1977 Germany .

*Primary Examiner*—John Niebling
*Assistant Examiner*—Brendan Mee
*Attorney, Agent, or Firm*—Pollock, Vande Sande & Priddy

[57] ABSTRACT

Apparatus for selective electrolytic deposition of a metal such as a noble metal such as gold onto the inside surface of bush type hollow bodies such as connector contact members comprising at least one system comprising substantially coaxial injector nozzle and suction nozzle. The suction nozzle has a diameter greater than that of the injector nozzle. Each bush to be plated is positioned facing a system so that the bush, the injector nozzle and the suction nozzle are in alignment, so that the injector nozzle does not enter the bush and so that a peripheral gap remains between the bush and the suction nozzle. A liquid electrolyte charged with a salt of the metal to be deposited is injected via the injector nozzles. An electrode is in electrical contact with the liquid electrolyte on the exit side of the injector nozzles. An electric current is passed between the bush and the electrode.

5 Claims, 2 Drawing Sheets

METHOD FOR SELECTIVE ELECTROLYTIC DEPOSITION OF A METAL IN PARTICULAR A NOBLE METAL SUCH AS GOLD, ONTO THE INSIDE SURFACE OF BUSH TYPE HOLLOW BODIES, IN PARTICULAR CONNECTOR CONTACT MEMBERS, MACHINE FOR IMPLEMENTING SAID METHOD AND PRODUCT OF SAID METHOD

BACKGROUND OF THE INVENTION

1. Field of the Invention

The invention concerns selective electrolytic deposition of a metal onto the inside surface of bush type hollow bodies, more particularly onto the inside surface of connector contact members, i.e., metal parts mounted on an insulative support which provide the electrical connection between the male and female halves of the connector.

If the metal to be deposited is a costly noble metal such as gold, it is advantageous to deposit it only onto the functional areas of the part, rather than over all of the part. In the case of a connector, these functional areas are the surfaces at which there is mechanical and electrical contact between the male and female members.

In the case of female contacts in particular, it is advantageous to coat the contact only on its inside surface, which is its functional surface.

In the specific case of female contacts which exhibit symmetry of revolution or like members such as bushes, as distinct from flat contacts such as lyre shape or lip type contacts, to which other coating techniques are appropriate, a method for selectively coating the inside surface only of the bush has already been proposed.

2. Description of the Prior Art

This known process is disclosed in EP-A-0 091 209 and in a number of later applications including WO-A-88/04699. It entails inserting an axial anode into the bush, injecting the electrolyte into the interior cavity of the bush and passing current between the axial anode and the body of the bush which forms the cathode of the electrolysis cell; injection is carried out in such a way that the electrolyte comes into contact with the axial anode inserted into the bush and with the interior wall of the bush.

This technique is effective for selective gold-plating of the inside surface of the bush, but there are problems, in particular:

- it is difficult to position and center the axial anode, especially in the case of bushes with a small inside diameter: it is essential for the anode not to touch the walls of the bush (which would cause a short-circuit in the electrolysis circuit) and for the accuracy of the concentricity of the anode and the bush to be sufficiently high to enable harmonious distribution of current flow between the anode and the cathode in order to obtain a regular deposit of metal on the walls of the bush;
- insertion of the anode into the bush implies a reciprocating movement which seriously reduces production throughput and increases the risk of loss of adjustment and breakdowns, due to the large number of moving parts which have to be reciprocated;
- finally, this technique is restricted to small depths of penetration as the previous two problems quickly become insurmountable as the depth of insertion of the anode in the bush increases.

One object of the invention is to remedy these drawbacks by proposing a gold-plating process (more generally, an electrolytic process of depositing a metal such as a noble metal) which restricts the electrolytic deposit to the inside surface only of a bush without requiring the insertion of an anode into the bush.

It will be shown that no reciprocating movement is necessary, and in this way the invention can significantly increase production throughput and the accuracy of centering and therefore the regularity of the gold-plating thickness.

Finally, it will be shown that the method of the invention can gold-plate the inside surface of the bush to a depth which is significantly greater than in the prior art without comprising the accuracy of the operation or the throughput.

The invention concerns only hollow parts with symmetry of revolution, such as bushes, but is applicable to all parts of this type, regardless of whether the bushes are manufactured by turning or by cutting and rolling in the case of female contact members.

SUMMARY OF THE INVENTION

The present invention consists in a method for selective electrolytic deposition of a metal such as a noble metal, such as gold, onto the inside of a bush type hollow body, such as a connector contact member, and comprises the steps of:

a) positioning the bush to face a system comprising an injector nozzle and a suction nozzle concentric with and of greater diameter than the injector nozzle, the system being so configured that the bush, the injector nozzle and the suction nozzle are aligned, that the injector nozzle does not enter the bush and that a peripheral gap remains between the bush and the suction nozzle, and b) simultaneously:

b1) injecting into the interior volume of the bush via the injector nozzle a liquid electrolyte charged with a salt of the metal to be deposited so that the liquid electrolyte wets the walls of the interior volume of the bush, and b2) passing an electric current between the bush and an electrode in electrical contact with the liquid on the output side of the injector nozzle to cause deposition of said metal on said walls of the interior volume of the bush wetted by said liquid injected by the injector nozzle.

Step (b) advantageously further comprises, simultaneously with operations (b1) and (b2), the simultaneous aspiration via the suction nozzle, (i) of air from the outside through the peripheral gap and (ii) or injected liquid discharged by the bush so that the aspirated air forms a protective jacket around the injector nozzle and the discharged liquid whereby the suction nozzle is able to recover the major part of the liquid.

In another aspect, the present invention consists of apparatus for carrying out the above method comprising:

- at least one system comprising an injector nozzle and a suction nozzle which are substantially coaxial, the suction nozzle having a diameter greater than that of the injector nozzle,
- means for placing each bush to be plated facing a system so that the bush, the injector nozzle and the suction nozzle are in alignment, so that the injector nozzle does not enter the bush and so that a peripheral gap remains between the bush and said suction nozzle, means for injecting via the injector nozzle a liquid electrolyte charged with a salt of the metal to be deposited, an electrode in electrical contact with the liquid electrolyte on the exit side of the injector nozzle, and means for passing an electric current between the bush and said electrode.

The machine advantageously further comprises means for simultaneously aspirating via the suction nozzle air from the outside via the peripheral gap and injected liquid discharged by the bush.

In one advantageous embodiment of the invention, the apparatus comprises a series of stacked plates mounted on a common shaft and constrained to rotate together synchronously with feed movement of the bushes, said three plates comprising:

a hollow first plate defining a first circular chamber connected at the center to the injector means and discharging at the periphery via a plurality of the injector nozzles which are parallel and oriented in the axial direction, a hollow second plate defining a circular second chamber connected at the center to the suction means and discharging at the periphery via a plurality of the suction nozzles which are oriented in the axial direction, the injector nozzles projecting from the first plate passing through the second plate so that each injector nozzle discharges substantially in the vicinity of a corresponding suction nozzle, and a third plate with means for guiding bushes fed successively and continuously to the machine adapted to move said bushes past said suction nozzles of said second plate.

The invention also encompasses a bush type contact member whose inside surface is selectively coated over the major part of its height with a metal, in particular a noble metal such as gold, by the above method.

An embodiment of the invention will now be described with reference to the appended drawings.

DETAILED DESCRIPTION OF THE INVENTION

Figure 1:
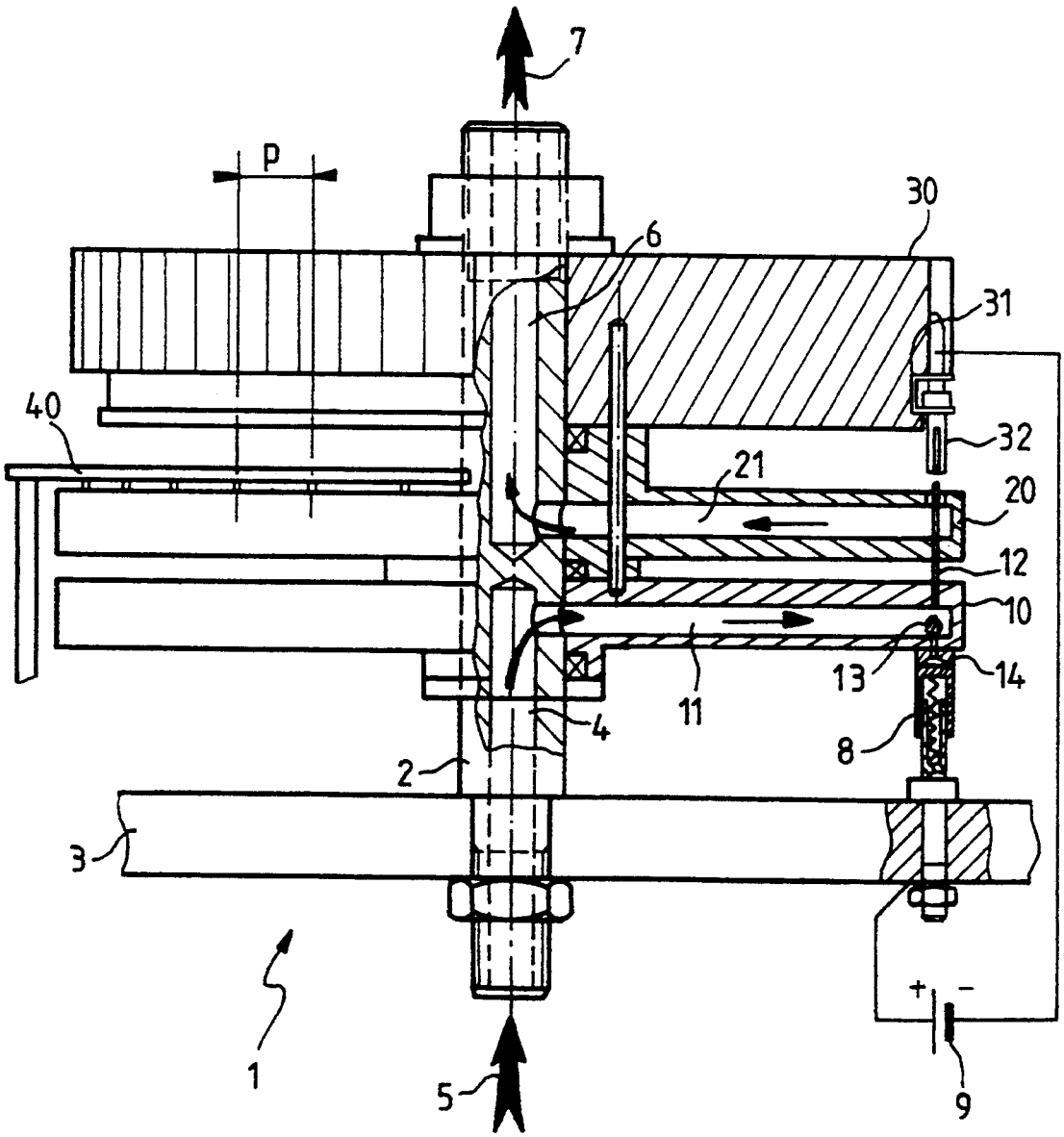
FIG. 1 shows, partly in cross-section, an apparatus for implementing the method of the invention.

The drawings show a machine in accordance with the invention for selectively gold-plating connector contact members.

It will be understood that the same teachings could be applied to the electrolytic deposition of a coating to the inside surface of hollow bodies other than connector contact members.

The machine 1 essentially comprises a fixed part in the form of a shaft 2 mounted on a horizontal support plate 3 attached to a frame of the machine. The fixed shaft 2 is hollow and its lower part comprises an axial cavity 4 connected to a pressurized liquid electrolyte supply (arrow 5). In its upper part is another, separate axial cavity 6 connected to suction means such as a vacuum pump (arrow 7).

The plate 3 also carries a brush 8 connected to the positive pole of an electrolysis current generator 9.

The fixed shaft 2 carries a set of three stacked circular plates 10, 20, 30 which are constrained to rotate together synchronously with the movement of the bushes to be processed which are fed to the machine on a conveyor belt. In this example, the rotation is continuous, but it could instead be stepwise and indexed to a pitch p corresponding to the interval between bushes, for example a pitch p of 1/120 turn.

The bottom plate 10 is hollow and has an inner chamber 11 in communication at all times with the pressurized cavity 4 of the fixed shaft. The plate carries at its periphery a plurality of vertical hollow needles 12 with a small inside diameter (in the order of 0.20 mm, for example) forming spray nozzles and communicating with the chamber 11. The needles 12 are equi-angularly distributed in a circle at the periphery of the plate 10 at a pitch which is a multiple of the pitch p of the contacts on the conveyor belt.

The chamber 11 contains an anode 13 in the form of a peripheral circular wire extending vertically below all the needles 12 and made of platinum-plated titanium, for example; this circular wire is electrically connected at a plurality of points to a circular metal ring 14 fixed under the plate and in contact with the brush 8 mentioned previously to connect the anode to the electrical power supply.

The second plate 20 is also hollow and its inner chamber 21 communicates at all time with the suction cavity 6 of the fixed shaft. The needles 12 on the plate 10 pass through the plate 20, to which they are sealed at the bottom (see FIG. 2) whereas at the top they pass through a concentric orifice 22 whose diameter is greater than that of the needles in order to constitute a suction nozzle, as will be described in more detail hereinbelow. The end 15 of the needle 12 preferably projects slightly above the level of the suction nozzle 22 in the axial direction.

The top plate 30 incorporates a groove receiving the belt 31 supporting the contacts 32 to be processed. In this example, these are turned contacts stored loose in bulk, in a vibrating bowl system, for example, from which they are taken to be placed on a conveyor belt which wraps over a circular arc on the top plate 30, which functions as a drum. However, the invention could equally well be applied to cut and rolled contacts still attached to the stripform blank from which they are made. The invention applies to all types of brushes, typically with inside diameters between 0.6 and 2 mm and more particularly between 1 and 2 mm.

In all cases, the conveyor belt is connected to the negative terminal of the generator 9, so that the contacts are all at the same potential as this terminal.

Figure 2:
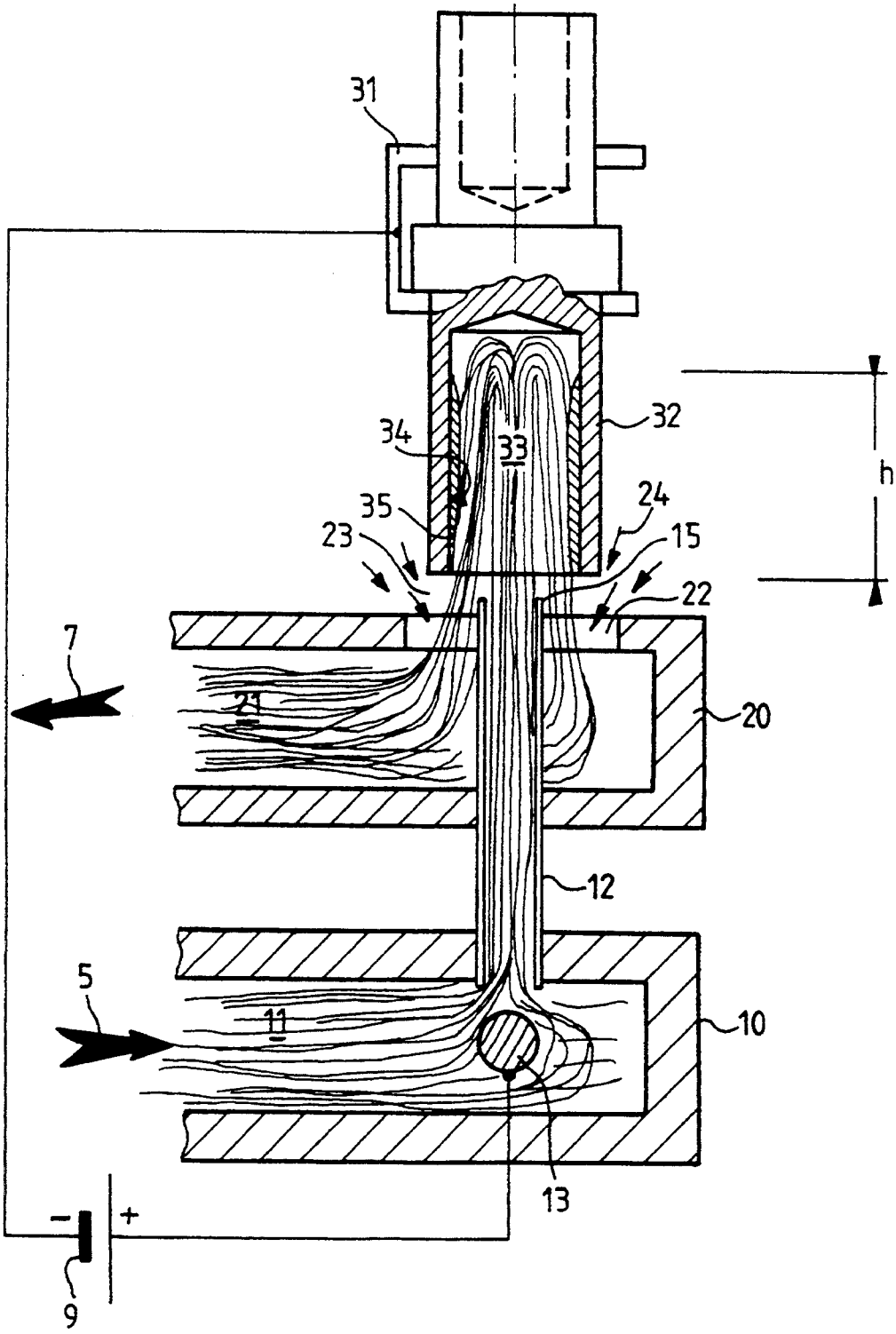
FIG. 2 is a more detailed view of the extreme right-hand part of FIG. 1, showing more clearly how the method of the invention is put into effect.

The operation of the machine in accordance with the invention will now be described in more detail with reference to FIG. 2.

The rotation of the top plate 30 drives the conveyor belt 31 continuously so that the contacts 32 are held above the plates 10 and 20 and in particular above the injector needles 12. The basic configuration between the plates is such that the hollow needle 12, the bush 32 and the suction nozzle 22 are all substantially coaxial and that, in the axial direction, the end 15 of the needle 12 does not enter the interior of the cavity 33 of the bush.

The "inactive" needles, i.e., those which are not under bushes 32, are shut off by a device 40 to prevent them from expelling the electrolyte.

The pressurized electrolyte fed into the chamber 11 at 5 passes through the hollow needle 12 whose end 15 injects the electrolyte into the interior cavity 33 of the bush 32. To prevent an "air plug" blocking complete access to the interior, split bushes or bushes pierced at the end are preferably used so that the cavity 33 is correctly filled with pressurized electrolyte.

The reduced pressure in the chamber 21 of the plate 20 causes the nozzle 22 to suck up the liquid injected into the cavity 33 via the needle 12 and discharged by the bush and also to suck in air from the outside via the gap 23 between the bush 32 and the nozzle 22 (arrows 24); this aspiration of air creates around the bush 32 a protective air jacket which confines the electrolyte discharged by the bush so that virtually all of it can be recovered by the vacuum pump connected to the chamber 21. The aspirated electrolyte mixed with air is then recovered to be injected again under pressure into the chamber in the bottom plate 10: the system thus operates in a closed circuit without significant loss of electrolyte (this feature is particularly advantageous in the case of a gold-plating bath, gold being a particularly costly product).

The passage of the current through the electrolyte from the anode 13 to the cathode consisting of the body of the bush causes metal to be deposited onto the inside surface 34 of the latter. The deposit 35 is formed to a height h which may be relatively large (in any event, much greater than with the prior art penetrating anode methods) and to a thickness which is extremely regular both axially and peripherally.

It can be seen that the deposit is formed without it being necessary to insert an anode into the interior volume 33 of the bush, with the result that the only movement of the machine is a rotation movement to drive the contact conveyor belt, deposition occurring continuously with no other movements, in particular with no reciprocating movement of the needles, which remain stationary relative to the three plates.

There is claimed:

1. Method for selective electrolytic deposition of a metal onto an inside of a bush type hollow body, said method comprising the steps of:

(a) placing said bush to face a system comprising an injector nozzle and a suction nozzle concentric with said injector nozzle and of greater diameter than said injector nozzle, said system being configured so that said bush, said injector nozzle and said suction nozzle are aligned, so that said injector nozzle does not enter said bush and so that a peripheral gap remains between said bush and said suction nozzle, and (b) simultaneously:

(b1) injecting into the interior volume of said bush via said injector nozzle a liquid electrolyte charged with a salt of the metal to be deposited so that said liquid electrolyte wets the walls of said interior volume of said bush, and (b2) passing an electric current between said bush and an electrode in electrical contact with said liquid electrolyte on an output side of said injector nozzle to cause deposition of said metal on said walls of said interior volume of said bush wetted by said liquid electrolyte injected by said injector nozzle.

2. Method according to claim 1, wherein step (b) further comprises, simultaneously with said operations (b1) and (b2), the operation of:

(b3) aspirating simultaneously via said suction nozzle (i) air from the outside through said peripheral gap and (ii) injected liquid electrolyte discharged by said bush to that the aspirated air forms a protective jacket around said injector nozzle and said discharged liquid electrolyte whereby said suction nozzle is able to recover a major part of said liquid electrolyte.

3. Apparatus for selective electrolytic deposition of a metal onto an inside surface of bush type hollow bodies, said apparatus comprising:

(a) at least one system comprising an injector nozzle and a suction nozzle which are substantially coaxial, said suction nozzle having a diameter greater than that of said injector nozzle;

(b) means for placing each hollow body to be plated facing a said system so that said bush, said injector nozzle and said suction nozzle are in alignment, so that said injector nozzle does not enter said bush and so that a peripheral gap remains between said bush and said suction nozzle;

(c) means for injecting via said injector nozzle a liquid electrolyte charged with a salt of the metal to be deposited;

(d) an electrode in electrical contact with said liquid electrolyte on an exit side of said injector nozzle; and (e) means for passing an electric current between said bush and said electrode.

4. Apparatus according to claim 3, said machine further comprising means for simultaneously aspirating via said suction nozzle (i) air from the outside via said peripheral gap and (ii) injected liquid discharged by said bush.

5. Apparatus according to claim 4, comprising a series of stacked plates mounted on a common shaft and constrained to rotate together synchronously with feed movement of said bushes, said three plates comprising:

(a) a hollow first plate defining a first circular chamber connected at the center to said injector means and discharging at the periphery via a plurality of said injector nozzles which are parallel and oriented in an axial direction, (b) a hollow second plate defining a circular second chamber connected at the center to said suction means and discharging at the periphery via a plurality of said suction nozzles which are oriented in a axial direction, the injector nozzles projecting from said first plate passing through said second plate so that each injector nozzle discharges substantially in the vicinity of a corresponding suction nozzle, and (c) a third plate with means for guiding bushes fed successively and continuously to the machine adapted to move said bushes past said suction nozzles of said second plate.

* * * * *